United States Patent [19]

Hamano

[11] Patent Number: 4,560,161

[45] Date of Patent: Dec. 24, 1985

[54] IMAGE DISPLAYING METHOD IN A CARD GAME MACHINE

[75] Inventor: Junichi Hamano, Nishinomiya, Japan

[73] Assignee: Takasago Electric Industry Co., Ltd., Osaka, Japan

[21] Appl. No.: 599,847

[22] Filed: Apr. 12, 1984

[30] Foreign Application Priority Data

Jul. 19, 1983 [JP] Japan ..... 58-132287

[51] Int. Cl.[4] ..... A63F 1/00

[52] U.S. Cl. ..... 273/85 CP; 273/DIG. 28

[58] Field of Search ..... 273/1 E, 85 CP, 237, 273/292, DIG. 28

[56] References Cited

U.S. PATENT DOCUMENTS 4,052,057 10/1977 Castle ..... 273/85 CP

OTHER PUBLICATIONS

Parlett, D. "Ganderpoke" in: *Original Card Games*, (London, Batsford, 1977), pp. 63–69.

*Primary Examiner*—Richard C. Pinkham
*Assistant Examiner*—Vincent A. Mosconi
*Attorney, Agent, or Firm*—Jordan and Hamburg

[57] ABSTRACT

The present invention relates to a card game machine wherein a game player plays a card game such as poker or the like on a CRT image displaying screen while operating keys. For instance, in the conventional poker game machine, only five cards selected in the machine are displayed on the screen, while the present invention modifies this playing method in such a manner that all the cards are displayed in an aligned fashion in a turned-over state. In accordance with the present invention, selection of the cards is performed by the game player himself or herself, and therefore the game becomes more interesting and has the effect of eliminating a feeling of doubtfulness or distinct about the game machine.

12 Claims, 9 Drawing Figures

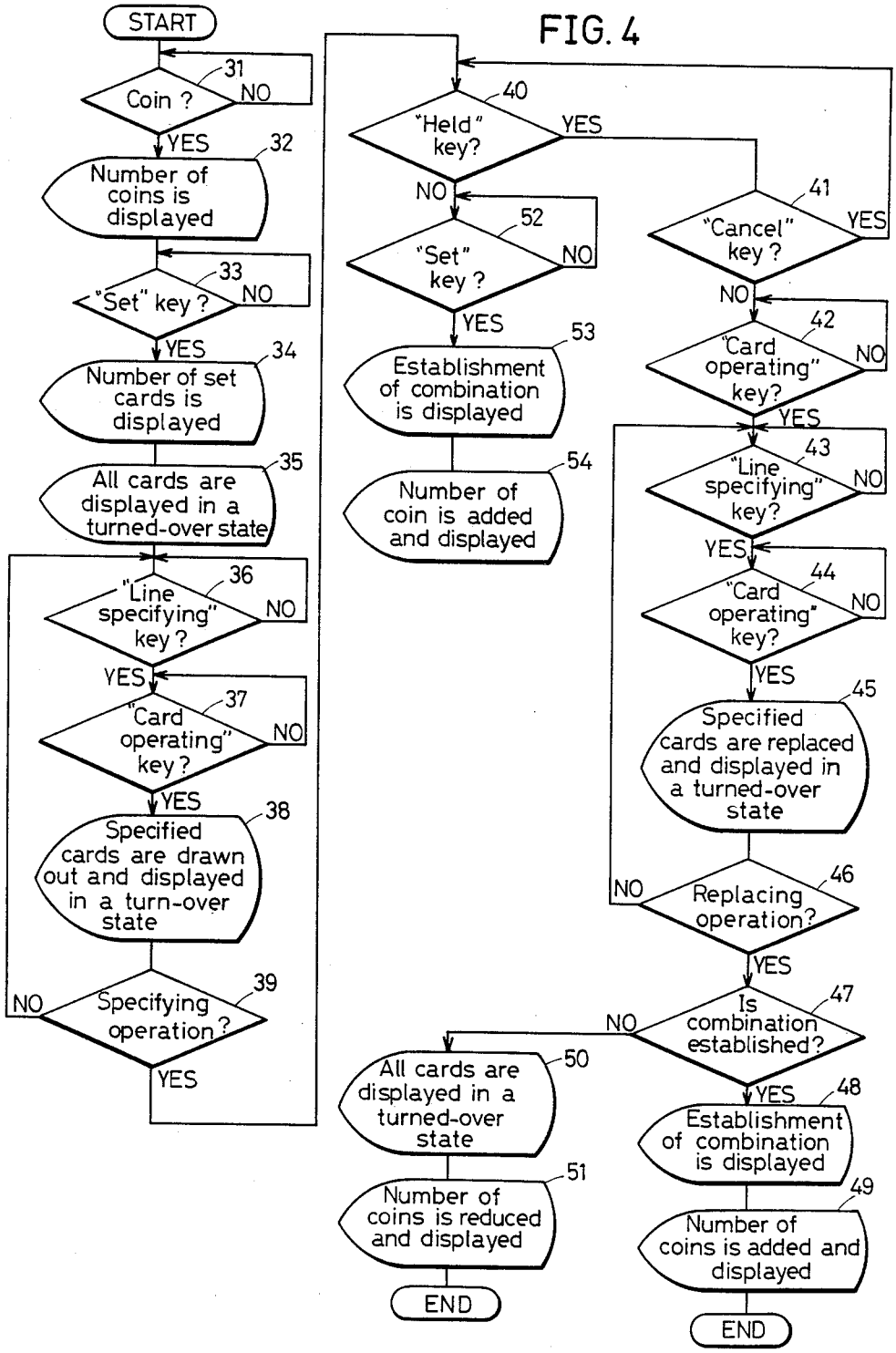
FIG. 4
START
Coin ?
31
NO
YES
Number of coins is displayed
32
"Set" key ?
33
NO
YES
Number of set cards is displayed
34
All cards are displayed in a turned-over state
35
"Line specifying" key ?
36
NO
YES
"Card operating" key ?
37
NO
YES
Specified cards are drawn out and displayed in a turn-over state
38
Specifying operation ?
39
NO
YES
"Held" key?
40
YES
NO
"Set" key ?
52
NO
YES
Establishment of combination is displayed
53
Number of coin is added and displayed
54
"Cancel" key ?
41
YES
NO
"Card operating" key?
42
NO
YES
"Line specifying" key?
43
NO
YES
"Card operating" key?
44
NO
YES
Specified cards are replaced and displayed in a turned-over state
45
Replacing operation?
46
NO
YES
Is combination established?
47
NO
YES
All cards are displayed in a turned-over state
50
Number of coins is reduced and displayed
51
END
Establishment of combination is displayed
48
Number of coins is added and displayed
49
END FIG.6 (1)
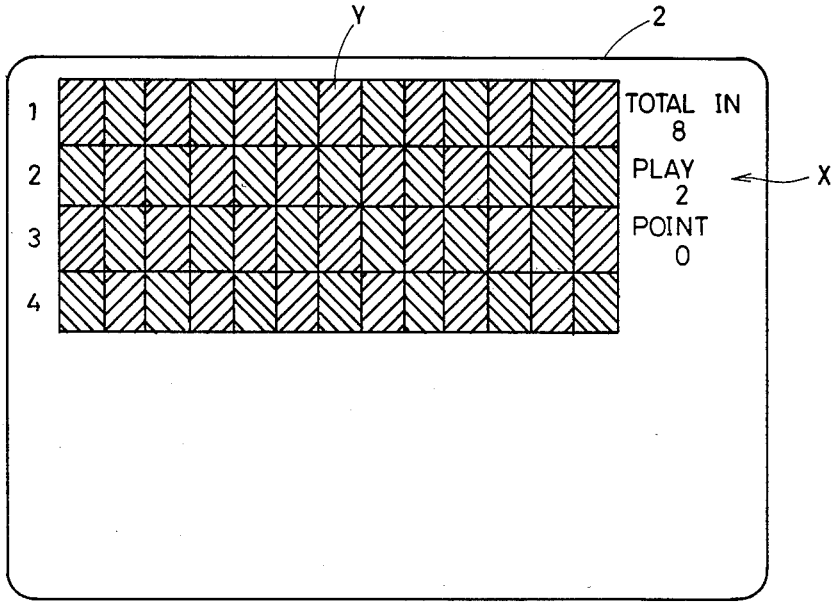
FIG.6 (2)
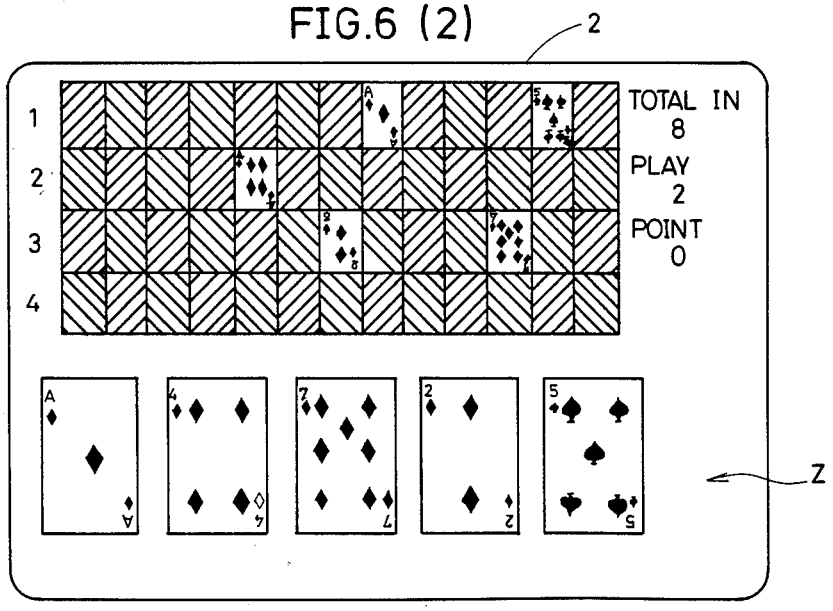

FIG. 6 (3)
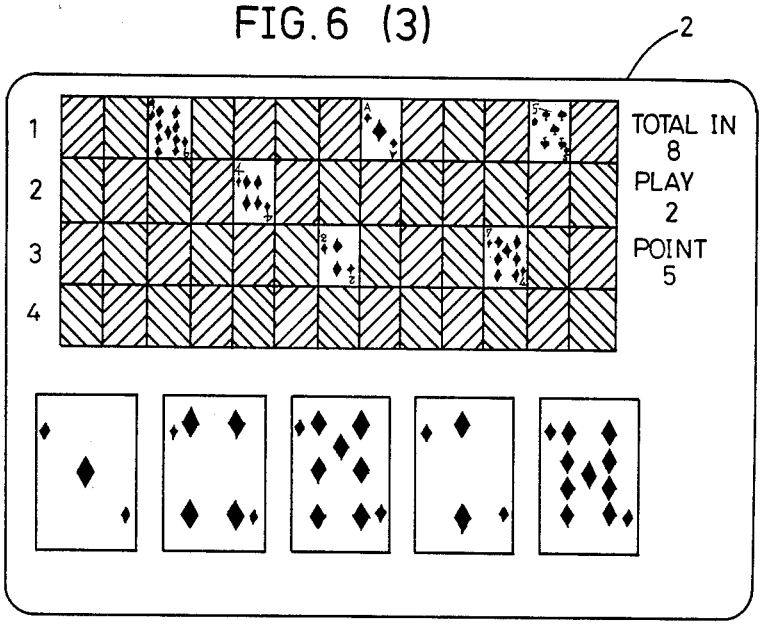
FIG. 6 (4)
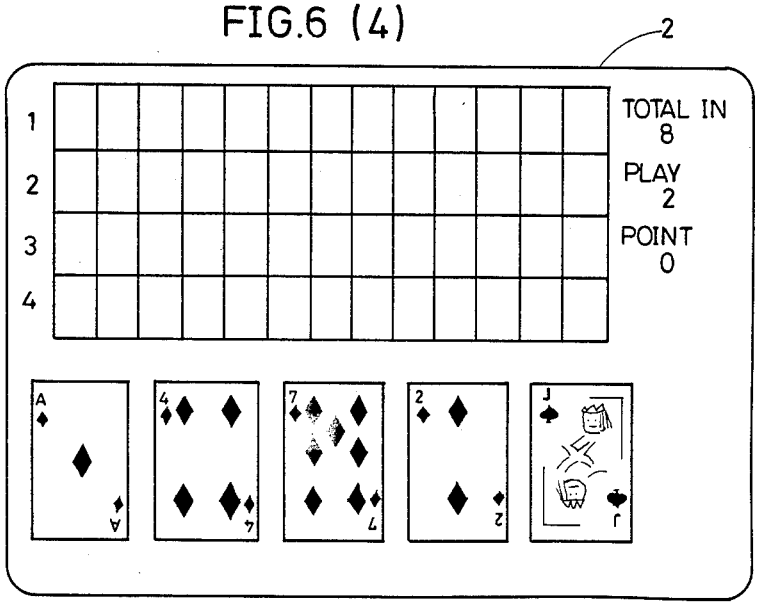

IMAGE DISPLAYING METHOD IN A CARD GAME MACHINE

SUMMARY OF THE INVENTION

The present invention relates to a card game machine wherein patterns of cards are displayed on a display screen, and the image is changed based on the player's operation of the keys, thereby card playing such as poker or the like is performed.

Conventionally, in this kind of game machine for a poker game, five cards are are displayed on the display screen simultaneously when starting the game. Then, when an unwanted card is specified by the key operation of the player, the specified card card is replaced, and then a new pattern is automatically displayed at the corresponding position. However, in this kind of system, the cards are automatically selected inside the machine, and therefore the game lacks interest and this is the cause of giving a feeling of doubtfulness or lack of trust to the player.

The present invention provides a card game which can completely eliminate a feeling of doubtfulness and distrust of the player by improving the method of displaying the card images on the screen.

In order to attain this objective, in the present invention, all cards are displayed in a turned down state and the cards required for that image row are specified and then the specified cards are turned up again in a normal state to be displayed, and also the cards are drawn out and the enlarged images of the card patterns are displayed.

In accordance with the present invention, selection of the cards can be made by the player himself or herself, so that interest in the game can be further enhanced and also a feeling of doubtfulness and distrust against the game machine can be eliminated, whereby an excellent effect is obtainable in attaining the purpose of the invention.

BRIEF DESCRIPTION OF THE SEVERAL VIEWS OF THE DRAWING

FIG. 4 is a flow chart showing operation of the game,

FIGS. 6(1) through 6(4) are plan views showing an embodiment of displayed contents.

DETAILED DESCRIPTION

Figure 1:
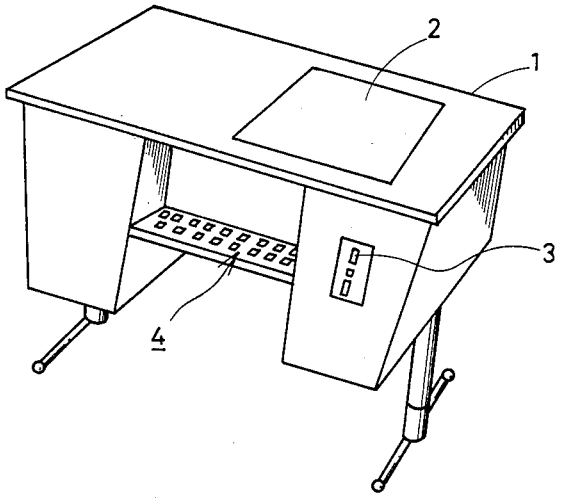
FIG. 1 is a perspective view of a poker game machine.

FIG. 1 shows a poker game machine wherein a method of displaying an image in accordance with the present invention is embodied.

Figure 2:
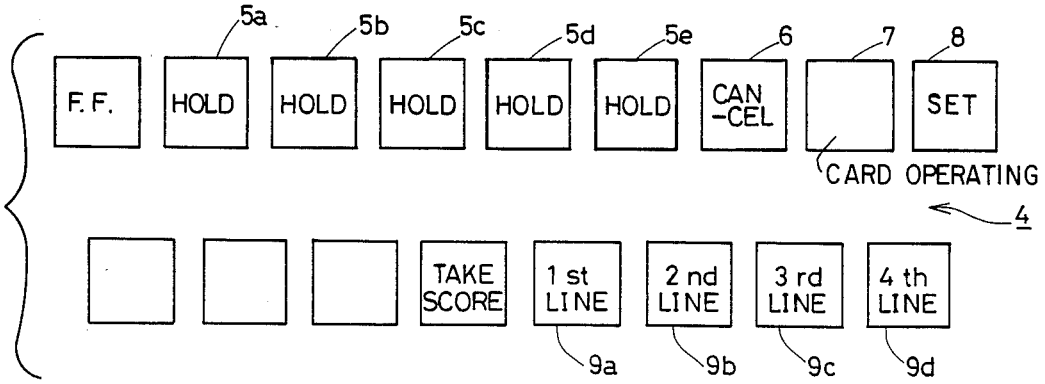
FIG. 2 is a plan view of key arrangement of a keyboard.

In a game machine exemplified by the drawing, a display screen of a CRT (Cathode Ray Tube) 2 is installed on the top surface of a table 1, and a coin inlet 3 and a keyboard 4 for playing the game are disposed on the front and rear surfaces of the table 1, respectively. As shown in FIG. 2, on the keyboard, various kinds of keys such as "Hold" keys 5*a* through 5*e*, a "Cancel" key 6, a "Card operating" key 7, a "Set" key 8, "Line Specifying" keys 9*a* through 9*d* and the like are disposed.

Figure 3:
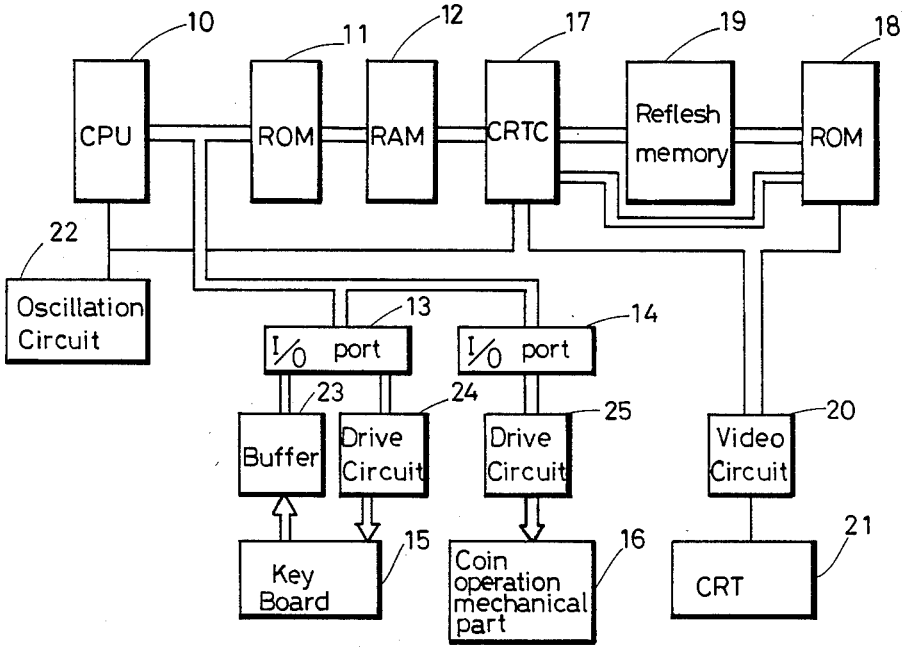
FIG. 3 is a circuit block diagram of a poker game machine.

FIG. 3 shows an example of circuit configuration of the poker game machine. In the figure, a CPU (Central Processing Unit) 10 executes various operations and processings while performing write/read of data for a RAM (Random Access Memory) 12 based on the program stored in a ROM (Read only Memory) 11, and also controls input/output operations of a keyboard 15 and a coin operation mechanical part 16 through 1/0 ports 13 and 14.

Based on a graphic code written to a refresh memory 19 corresponding to the control operation of CPU 10, CRT controller 17 reads out the image pattern of the card corresponding to that code from a ROM 18 on a line or column basis and makes a data conversion into serial data. This data is transmitted to a video circuit 20 as video signals, and by the video circuit 20, a predetermined image is displayed on a CRT 21 based on the video signals.

Furthermore, an oscillation circuit 22 sends out clock signals determining the operation timings of the CPU 10 and the CRT controller 17. Also, a buffer 23 holds the key input information, and a drive circuit 24 performs operations such as lighting the set lamps in the keys and the like. Further more, a drive circuit 25 drives the coin operation mechanical part 16 to execute the coin detection and release operation.

Figure 5:
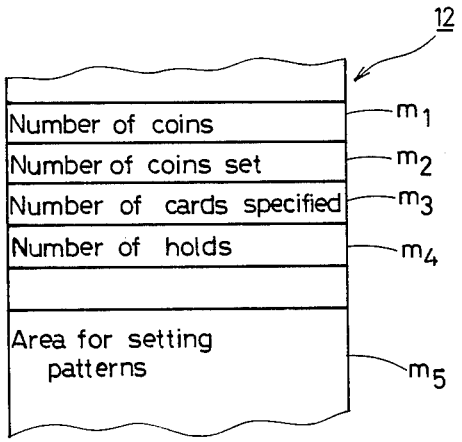
FIG. 5 is an explanatory view showing a memory configuration of RAM.

FIG. 4 shows an operational flow of the poker game machine. To start with, an appropriate number of coins (for example, 10 pieces) are thrown into the coin inlet 3, and thereby Step 31 becomes "Yes", and the number of coins thrown into is set in an area $m_1$ of the RAM 12 (illustrated in Fig. 5) also in step 32, the number of coins thrown, that is the numeral "10" is displayed on a numeric display part X at the side part of the display screen. Subsequently, by depressing the "Set" key repeatedly by the times equivalent to the multiplying factor (for example, 2) Step 33 becomes "Yes", and the number of set coins is set in an area $m_2$ of the RAM 12. Furthermore, in Steps 34 and 35, the number of set coins "3" is displayed on the above-mentioned numeric display part X, and also, as shown in FIG. 6(1), all 52 cards are displayed in an alignment of 4 lines × 13 columns in a turned-over state on a card alignment display screen 2. Each pattern of these aligned cards has been specifically fixed at the point of operation of the above-mentioned "Set" key 8, and the patterns of each line and each column have been set in an area of $m_5$ of RAM 12 with predetermined codes.

Subsequently, the operation of drawing five cards out of the above-mentioned card alignment is performed. For example, when the card on the first line and the eighth column is intended to be drawn, by depressing the "Line specifying" key 9*a* specifying the first line, the cards of the first line on the display screen 2 are illustrated in sequence. Then, when the position of illumination comes to the card on the eighth column, depressing of the "Line specifying" key 9*a* is released. Subsequently, when the "card operating" key 7 is depressed, Step 36 and 37 are "YES", and in step 38, the specified card is turned-up and the pattern is displayed on the card is drawn out and the enlarged image of the drawn pattern is displayed on the drawn card display part Z at the lower part of screen 2. When the same operation is repeated five times, the number of cards specified is added to an area $m_3$ of RAM 12 each time, and consequently, as shown in FIG. 6(2), five cards are turned up at the card alignment display part Y, and the enlarged images of the card patterns are displayed on the drawn card display part Z according to the sequence of drawing the cards. Furthermore, in this state, the decision of "Is specifying operation completed?" in Step 39 is "YES".

Now, noting the card patterns in FIG. 6(2), four cards are diamonds, and therefore, when the "5" of spades is changed to a diamond, the combination of "flush" in the poker game is established. Then, when the cards other than the "5" of spades are held by depressing the first "Hold" key 5*a* through the fourth "Held" 5*d*, Step 40 becomes "YES", and the number of hold "4" is set in an area $m_4$ of RAM 12. Subsequently, by depressing the "card operating" key 7, Step 41 becomes "NO" and Step 42 becomes "YES", and then the card replacing operation is performed. In this operation, for example, when the card on the first line and the third column is intended to be specified, like the above-mentioned case, the "Line specifying" key 9*a* specifying the first line is depressed and when the illuminated lamp moves to the card position on the third column, depressing of the "Line specifying" key 9*a* is released. Subsequently, when the "Card operating " key 7 is depressed, and Steps 43 and 44 are "YES", and in Step 45, the specified card is turned up and the pattern is displayed on the card column, and also the fifth card is erased and the pattern of the card now specified is displayed anew in step at the same position. Assuming that this replaced card is, for example, as shown in FIG. 6(3), the "9" of diamonds, the above-mentioned combination of "flush" is established, and both decisions in Step 48, the display telling the establishment of the combination is displayed at an appropriate position on the display screen 2, and the prize rate equivalent to "flush" multiplied by the number of coins set is added to the present number of coins, and the display of the numeric display part X is renewed (Step 49).

Assuming that the replaced card is, for example, as shown in FIG. 6(4), the "Jack" of spades, no combination is established and Step 47 becomes "NO". In this case, in Step 50, all the cards at the alignment display part Y are turned up to display their patterns, and thereby the player can make sure of the contents of the aligned cards afterward. Then, the number of coils set is subtracted from the coin number in Step 51 and the display at the numeric display part X is renewed likewise.

Furthermore, in the case where five cards constitute some combination from the beginning, any "Hold" key is immediately depressed, and the "Set" key 8 is immediately depressed. Thereby Step 52 becomes "YES", and the display indicates an establishment of the combination is made in Step 53, and the number of coins is added in the next Step 54, the display being renewed.

What is claimed:

1. An image displaying method for a card game machine comprising displaying all 52 cards of a deck in aligned array face down on a display screen in a first display area, displaying selected cards face up in said aligned array in response to selective input by a card player, displaying said selected cards face up in a second display area, removing the display of an undesired card from said second display area in response to a selective input by the card player, displaying another selected card face up from said aligned array of face down cards on said first display area in response to a selected input by the card player, displaying the last said selected card face up on said second display area, and simultaneously with said last step, continuing to display in said first display area the first said selected cards and simultaneously therewith displaying in said first display area said other selected card, whereby a player can thereby select desired cards from the aligned array of face down cards and replace unwanted cards with a second selection of desired cards from said aligned array of face down cards to thereby simulate card playing.

2. An image displaying method according to claim 1 further comprising displaying said cards on said second display area enlarged relative to the cards displayed on said first display area.

3. An image displaying method according to claim 1 further comprising displaying all of the cards face up in aligned array in said first display area after the game is completed so that a player can verify that all of the cards are included in said aligned array.

4. An image displaying method according to claim 1, wherein said step of displaying all of the cards face down in aligned array comprises displaying the cards in columns and lines to facilitate selection designation by a card player.

5. An image displaying method according to claim 1, wherein said second display area displays five cards whereby the card game machine is capable of playing poker.

6. An image displaying method according to claim 5, wherein said step of displaying selected cards face up in said aligned array comprises displaying five cards in response to five separate selective inputs by said card player.

7. An image displaying method for a poker game machine comprising displaying all 52 cards of a deck in aligned array face down on a display screen in a first display area, displaying a first group of selected cards face up in said aligned array in response to a first selective input by a card player, displaying said first group of selected cards face up in a second display area, maintaining the display of said first group of selected cards in said first display area so that said first group of selected cards are simultaneously displayed in said first and second display areas, removing the display of at least one undesired card from said second display area in response to a second selective input by the card player, displaying said at least one selected card face up from said aligned array of face down cards on said first display area in response to a third selected input by the card player, displaying the last said at least one selected card face up on said second display area, maintaining the display of said at least one selected card on said first display area so that said at least one selected card is simultaneously displayed in said first and second display areas, continuing to display in said first display area said first group of selected cards so that said first display area simultaneously displays said first group of selected cards along with said at least one selected card, and continuing to simultaneously display in said second display area said at least one selected card and said first group of selected cards, except for said undesired card, whereby a player can thereby select desired cards from the aligned array of face down cards and replace unwanted cards with another selection of desired cards from said aligned array of face down cards to thereby simulate card playing.

8. An image displaying method according to claim 7 further comprising displaying said cards on said second display area enlarged relative to the cards displayed on said first display area.

9. An image displaying method according to claim 7 further comprising displaying all of the cards face up in aligned array in said first display area after the game is completed so that a player can verify that all of the cards are included in said aligned array.

10. An image displaying method according to claim 7, wherein said step of displaying all of the cards face down in aligned array comprises displaying the cards in columns and lines to facilitate selection designation by a card player.

11. An image displaying method according to claim 7, wherein said second display area displays five cards whereby the card game machine is capable of playing poker.

12. An image displaying method according to claim 11, wherein said step of displaying selected cards face up in said aligned array comprises displaying five cards in response to five separte selective inputs by said card player.

* * * * *